United States Patent [19]

Mayer

[11] 4,222,711

[45] Sep. 16, 1980

[54] SUMP PUMP CONTROL SYSTEM

[75] Inventor: Thomas J. Mayer, Phoeniz, Ariz.

[73] Assignee: I²DS, Elk Grove Village, Ill.

[21] Appl. No.: 917,858

[22] Filed: Jun. 22, 1978

[51] Int. Cl.³ ..... F04B 49/00; F04B 49/06

[52] U.S. Cl. ..... 417/7; 417/36

[58] Field of Search ..... 417/2–9, 417/12, 36, 44, 63

[56] References Cited

U.S. PATENT DOCUMENTS

| | | | |
|---|---|---|---|
| 3,726,606 | 4/1973 | Peters | 417/7 |
| 3,744,932 | 7/1973 | Preuett | 417/8 |
| 3,941,507 | 3/1976 | Niedermeyer | 417/44 |
| 4,061,442 | 12/1977 | Clark | 417/36 |
| 4,087,204 | 5/1978 | Niedermeyer | 417/2 |
| 4,095,920 | 6/1978 | Needham | 417/12 |

*Primary Examiner*—William L. Freeh

*Attorney, Agent, or Firm*—Edmond T. Patnaude

[57] ABSTRACT

An AC driven pump and a DC driven pump are positioned in a sump and respectively energized as the liquid in the sump reaches two different levels, the DC driven pump being automatically tested for operation after every predetermined number of pumping cycles of the AC driven pump.

6 Claims, 3 Drawing Figures

SUMP PUMP CONTROL SYSTEM

The present invention relates in general to liquid level control systems, and it relates in particular to a new and improved system for controlling the operation of a pair of AC and DC operated pumps and the invention also relates to a novel liquid level sensing probe.

BACKGROUND OF THE INVENTION

In order to prevent underground basements or cellars from flooding, it is the common practice in many areas of the United States to provide a sump in the floor of the basement and to position an AC motor driven pump in the sump. Some type of liquid level sensing device is provided to energize the motor when the liquid level in the sump reaches a predetermined height and to deenergize the motor when the level has dropped to a safe level. Various types of sensing devices have been used for this purpose including float operated switches, pressure responsive switches, and conductive and capacitive probes.

The systems of this general type have two basic disadvantages, i.e., they may not function when needed in an emergency because of a power failure or they may fail to operate because the level sensing device fails to operate. In order to avoid the disadvantages of the float operated and pressure operated level sensors, attempts have been made to use conductive or capacitive sensors. However, the level sensing devices of these types may be spuriously actuated by soap suds in the sump. Moreover, the electric sensing probes in these devices are susceptible to corrosion and/or errosion and thus have a relatively short life.

In an attempt to solve the problem of power failure during those periods when pumping is necessary, battery operated DC motor driven pumps have been mounted in the sumps alongside or above the AC motor driven pumps with the DC motor circuit being activated in response to a power line failure. Moreover, alarms have been provided for giving a warning if the battery voltage falls below a predetermined level. Unfortunately, these auxiliary DC systems have left much to be desired in preventing flooding due to AC motor driven pump failure.

By way of example, such systems do not make use of the battery operated pump in those cases where there is no power failure but where the AC driven pump fails, nor is the battery operated pump utilized when the capacity of the AC driven pump makes it incapable of handling the inflow of water to the sump. Also, since the battery operated pumps are rarely used, they sometimes are inoperative when their use is required. This may occur because of the rotor becoming locked up or because the battery is incapable of supplying the power necessary to drive the pump. Although the static battery voltage may appear to be satisfactory, the initial current drain may reduce the battery voltage below the usable value.

SUMMARY OF THE INVENTION

Briefly, there is provided in accordance with the present invention a novel system for controlling the operation of an AC motor driven pump and a battery operated DC motor driven pump to maintain the level of liquid in the sump below a predetermined maximum level. A level sensing probe of novel construction depends into the sump and functions to complete the energization circuit of the AC motor when the liquid rises to a first level and to complete the energization circuit of the DC motor when the liquid level rises to a second and higher level. It may thus be seen that the battery operated sump is operated irrespective of the reason for the AC pump not maintaining the water below the second level, and both pumps may, therefore, be operated simultaneously where their combined capacities are required.

In accordance with another important aspect of this invention, after every predetermined number of times the AC motor driven pump goes through a pumping cycle, the DC motor is energized for the subsequent pumping cycle. Should the DC pump fail to function properly for any reason during this test mode, an alarm is sounded and the AC motor is energized. In this manner the battery operated pump is automatically tested at periodic intervals so that the liklihood of it failing in an emergency is remote.

In accordance with another aspect of the invention, the probe assembly includes an imperforate, tubular shroud hermetically sealed at the top and enclosing at least the upper portion of a plurality of conductive probe elements. This novel probe construction provides an air pocket around the base or upper ends of the probe elements to prevent contact thereof by the liquid in the sump and to minimize the effects of soap suds or of a floating emulsion on the sensitivity of the probe. Also, this novel shroud reduces the required length of the probe inasmuch as a given increase in liquid level in the sump results in a lesser increase in liquid level within the shroud where the second level sensor element is disposed.

GENERAL DESCRIPTION OF THE DRAWINGS

Further features of the present invention and a better understanding thereof may be had from a reading of the following detailed description taken in conjunction with the accompanying drawings wherein.

DETAILED DESCRIPTION OF THE INVENTION

Figure 1:
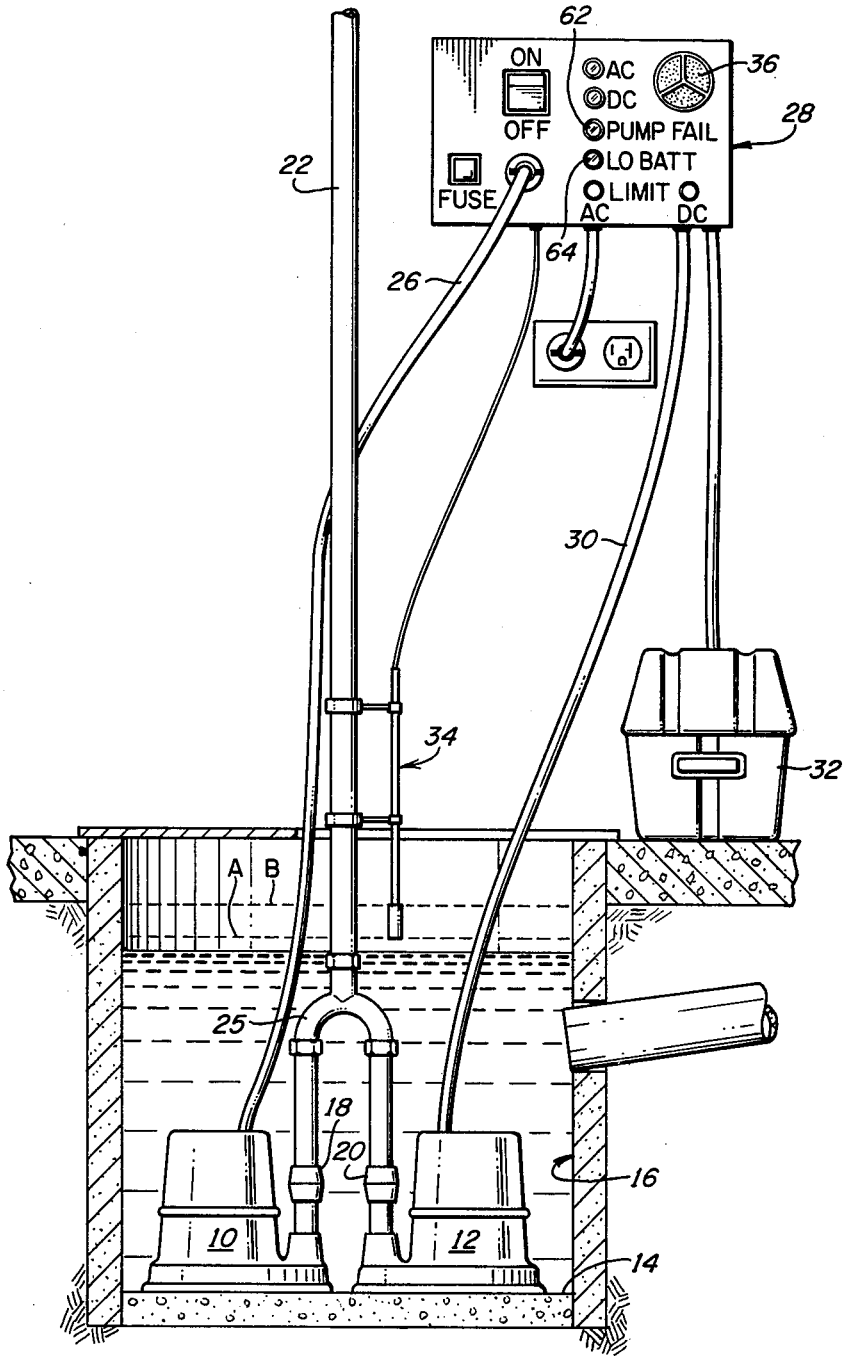
FIG. 1 is an elevational view of an AC-DC sump pump system embodying the present invention.

Referring in particular to FIG. 1 of the drawings there is shown an AC motor driven pump 10 and a DC motor driven pump 12 resting on the floor 14 of a sump 16. The pumps 10 and 12 are of the submerisble type wherein thr respective motors are enclosed in hermetically sealed housings. It will be understood, however, that the present invention is equally suited for pumps of the type wherein the motors are mounted separately from the pumps at elevations above the maximum water level to be encountered. The outlet ports of the two pumps are respectively connected through a pair of check valves 18 and 20 to a discharge conduit 22 via a Y-connector 25. A three conductor cable 26 connects the AC motor to a control box 28 and a similar cable 30 connects the DC motor to the control box 28 and to a battery located in a protective battery case 32. A probe assembly 34 is mounted to the discharge conduit 22 and is electrically connected to the control box 28. As more fully described hereinafter, the probe assembly is a water level sensor which provides a first electric signal when the water in the sump reaches a first level A and a second electric signal when the water in the sump reaches level B.

When the water level in the sump rises to elevation A and is sensed by the probe assembly 34, the AC motor driven pump 10 is energized to pump water out of the pump 16 through the discharge conduit 22. The AC motor driven pump 10 then remains energized for a predetermined time after the water level falls below elevation A. Should, however, the AC pump fail to operate, the water level in the sump will generally continue to rise, and when the water level reaches elevation B a second signal from the probe assembly results in the energization of the DC motor driven pump 12. The DC motor driven pump then remains energized for a predetermined time after the water level falls below elevation B. If the water level reaches elevation B because of an interruption in AC power from the power line or because of a failure of the AC motor or the associated pump, the DC motor driven pump 12 functions as a standby which is automatically set into operation to perform the pumping function normally performed by the AC motor driven pump. If, on the other hand, the water level reaches elevation B because the capacity of the AC motor driven pump is insufficient to handle the flow of water into the sump, then the two pumps are operated simultaneously to prevent the water from over-flowing the sump 16.

The circuit elements contained in the control box 28 provide for the automatic testing of the DC motor driven pump, and of the voltage across the power terminals of the battery. In addition, there is provided several alarm devices which provide various warnings as to the inoperativeness of different parts of the pumping system. For example, when the water level reaches elevation B, an audible alarm device 36 is triggered on and remains on until manually turned off. Moreover, several lamps are mounted on the front face of panel of the control box to provide a visual indication of several factors including AC motor driven pump failure, DC motor driven pump failure, and low battery voltage.

As is well known in the art, it is only on infrequent occasions that the use of the DC motor driven pump will be required, but it is most important that the DC motor driven pump function properly when its use is required. One reason for a possible failure of the DC motor driven pump is a failure of the battery to provide sufficient power. The system of the present invention constantly monitors the output voltage of the battery and provides a warning if such voltage falls below a predetermined value. In addition, rectifier means is incorporated in the control box 28 for charging the battery from the AC power line.

There are however, several other reasons for failure of the DC motor driven pump to operate when needed. For example, the DC motor may be defective, the pump may be defective or plugged or the battery may not provide sufficient power even though the voltage thereof during nonuse is at a satisfactory level. Therefore, in accordance with an important aspect of the present invention, means are incorporated in the control circuit for automatically testing the operation of the entire DC pumping system, and one particular embodiment of this feature of the invention is described in detail hereinafter in connection with FIG. 3. In this embodiment of this invention a counter in the control circuit counts the number of pumping cycles of the AC motor driven pump until the count reaches a predetermined number whereupon the system is switched automatically to a test mode of operation. Then, when the water level next reaches elevation A the DC motor driven pump 12 rather than the AC driven motor 10 is energized. If the pump 10 functions properly the system is returned to normal operation. On the other hand, if the DC motor driven pump had failed to operate satisfactorily the water level would have risen to elevation B causing the alarm devices to be energized and the AC motor driven pump 12 to be energized to prevent the water from overflowing the sump.

Figure 2:
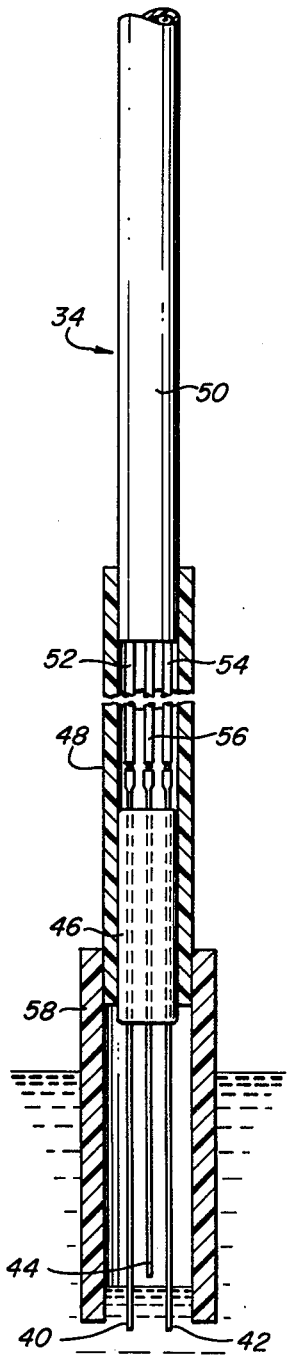
FIG. 2 is an elevational view, partly in section of a novel probe assembly embodying the present invention.

Referring now to FIG. 2 wherein the probe assembly 34 is shown in detail, a plurality of electrically conductive metal rods 40, 42 and 44 extend through an insulating support member 46. Preferably the member 46 is molded around the rods to provide hermetic seals therewith. A tubular stem 48 is tightly fitted over the support member 46 and is sealably bonded thereto. A cable 50 is fitted into the upper end of the stem 48 and has three mutually insulated conductors 52, 54 and 56 respectively connected to the upper ends of the rods 40, 42 and 44. A tubular shroud 58 is fitted over the lower end of the stem 48 and is sealably bonded thereto. The rods 40 and 42 are of the same length wherefor their lower ends are at the same elevation, and in the illustrated embodiment of the invention extend a short distance below the bottom open end of the shroud 58. The lower ends of the rods 40 and 42 are at elevation A as shown in FIG. 1. If desired, however, these two rods 40 and 42 could terminate within the shroud. The lower end of the rod 44 is at higher elevation than the ends of the rods 40 and 42 and is used in detecting the presence of water at elevation B. It will be apparent that inasmuch as the rod 44 terminates within the shroud, when the shroud is immersed in water the level of water in the sump will be much greater than the level of water within the shroud. As a consequence, the difference in elevation between the lower ends of the probe elements or rods 40, 42 and the probe element or rod 44 can be substantially less than the difference in elevation between levels A and B and thus permit use of a shorter probe assembly. When, for example, one-half inch of elevation is provided between the lower ends of the probes, the difference between elevations A and B may be inches.

The shroud 58, being sealed at the top, prevents the water or other liquid in the sump from ever reaching the lower end of the support member 46. If the water were to reach the support member 46 the subsequent corrosion and errosion of the rods and the low resistance film across the bottom of the support member 46 would soon render the probe assembly inoperative. Additionally, the shroud functions to restrain soap suds or the like from moving up against the element 44 and thus cause a false indication of the actual water level in the sump.

Figure 3:
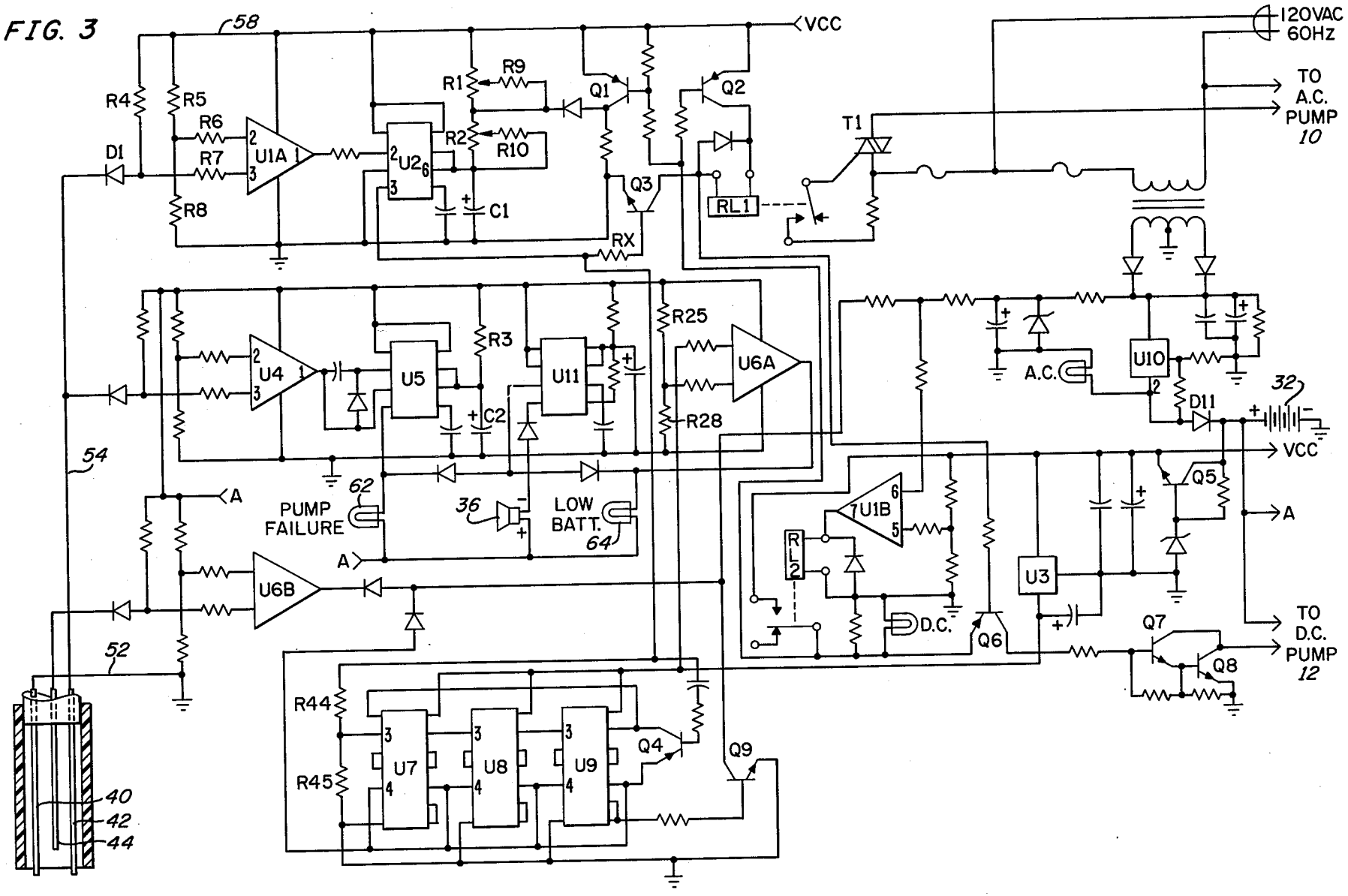
FIG. 3 is a schematic diagram of a control circuit embodying certain aspects of the present invention.

Reference is now made to FIG. 3 wherein is shown in schematic form the circuit used to control the operation of the pumps 10 and 12 in the manner described hereinabove. This control circuit is housed within the control box 28 which may be conveniently mounted to a wall in proximity to the sump 16 and to an AC electric outlet connected to the public power supply lines. As shown, the element 40 in the probe assembly is connected via the conductor 52 to ground. The element 42 is connected via the conductor 54 to the negative terminal of a diode D1 having its positive terminal coupled by a resistor R7 to one input of a noninverting operational amplifier UIA and via a resistor R4 to a regulated DC voltage bus 58 having a voltage of about +9 volts. The other input terminal 2 of the operational amplifier UIA is coupled to the bus 58 by resistors R5 and R6 with resistor R8 being connected between resistor R5 and ground to provide a voltage of about 5 volts DC on input terminal 2 and a Hi voltage at output terminal 1.

When the water level in the sump reaches elevation A, the probe elements 40 and 42 are electrically interconnected by the water in the sump to cause the voltage on input terminal 3 of the operational amplifier UIA to go low and the voltage on the output terminal 1 thereof to go low resulting in a non-timing high output at output terminal 6 of a timer U2. This timer output terminal is coupled by a resostpr R'X' to the emitter of a transistor Q3 to forward bias the transistor which in turn causes relay RL-1 to pick up and energize the AC pump 10 via a triac T1.

As the pump 10 thus pumps water out of the sump the water level drops until the connection between the probe elements 40 and 42 is broken. When this occurs, terminal 3 of the operational amplifier UIA goes high causing the output terminal 1 thereof to go high to release the input terminal 2 of the timer U2. Capacitor C1 then charges through resistors R2 and R10 until time U2 times out, raising the voltage at the base of the transistor Q3 until it exceeds the cutoff level causing the relay RL-1 to drop out and the AC pump 10 to be deenergized. The time delay between the breaking of the connection between the probe elements 40 and 42 and the deenergizing of the AC pump 10 may thus be adjusted by means of the adjustable resistor R2. This time may be such, for example, that the water level is about three inches below the probe assembly when the pump is deenergized under normal conditions.

The output terminal 3 of the timer U2 is coupled via a resistor R44 across a resistor R45 to the clock input terminal 3 of a counter stage U7 which is part of a three stage counter including the second and third stages U8 and U9. The counter stages U7, U8 and U9 make up a divide by thirty-two chain which counts once each time the clock input terminal goes high. On the thirty-second input transistion from low to high the transistor Q9 is forward biased causing input terminal 6 of an operational amplifier UIB to go low and its output terminal 7 to go high causing a relay RL2 to pick up. When relay RL2 picks up, transistor Q2 is reverse biased to prevent the relay RL1 from picking up thus preventing the energization of the AC pump 10. Also transistor Q1 changes the time constant of the counter U2. Therefore, when the water level in the sump next reaches the probe elements 40 and 42 and the output of the counter U2 goes high, transistors Q3, Q6, Q7 and Q8 are forward biased to energize the DC pump 12 from the battery 32. After a predetermined time delay as set by the adjustable resistor R2, the transistor Q3 becomes non-conductive and thus renders the transistor Q6, Q7 and Q8 non-conductive to deenergize the DC pump 12. When the output terminal 3 of the counter U2 goes low to turn off the transistor Q3 the base of a transistor Q4 also goes low to couple a reset pulse to the reset terminals 4 of each of the counter stages U7, U8 and U9. Hence the counter is reset and the system returns to the AC mode of operation for the next thirty-two pump cycles.

Should the system fail to reduce the level of water below the probe elements 40 and 42 for any reason and the water level reaches probe element 44, the input terminal 3 of an operational amplifier U4 goes low causing the output terminal thereof to also go low to release the counter U5. After a time delay of say thirty seconds as determined by the values of the resistor R3 and the capacitor C2, the output terminal 3 of the timer U5 goes low causing terminal 1 of a monstable multi-vibrator U11 to go low to intermittently energize an audible alarm device 60. Moreover, an alarm lamp 62 is energized. It will be apparent that if the water level subsequently drops below the probe element 44 both the lamp 62 and the alarm 60 will be deenergized.

In the event that the AC pump is energized and operating but its capacity is insufficient to pump out the water entering the sump, the output of an operational amplifier U6B will go low, and being coupled by resistor R29 to the input terminal 6 of the operational amplifier U1B, causes relay RL2 to pick up and energize the DC pump, 12.

In order to detect and indicate if the battery voltage is low, input terminal 3 of an operational amplifier U6A is held at about six volts by the voltage divider network R25, R28 connected between the twelve volt DC bus A and ground. Normally, bus A is at about 12 volts but should it fall below about 6 volts the output terminal 1 of the operational amplifier U6A will go low causing the "low battery" lamp 64 to be energized. The system does, however, include a 12 volt regulator U10 having a positive output terminal 2 connected through a blocking diode D11 to the positive terminal of the battery 32 for supplying charging current to the battery. When the battery has been recharged, the lamp 64 is automatically deenergized.

While the present invention has been described in in connection with particular embodiments thereof, it will be understood by those skilled in the art that many changes and modificiations may be made without departing from the true spirit and scope of the present invention. Therefore, it is intended by the appended claims to cover all such changes and modifications which come within the true spirit and scope of this invention.

What is claimed:

1. Apparatus for pumping liquid from a sump or the like to maintain the liquid surface below a predetermined level, comprising an AC operated pump positioned in said sump, a DC operated pump positioned in said sump, control means responsive to the level of said liquid in said sump for energizing said AC operated pump when said surface is at a first level and for energizing said DC operated pump when said AC operated pump is unable to pump water from said sump at a flow rate not less than the rate at which water is entering said sump, counter means for providing a count of the number of times said AC operated pump is energized and subsequently deenergized, and means responsive to said count for causing the energization of said DC operated pump the next time said liquid surface is at said first level after said count reaches a predetermined number, whereby the operation of said DC operated pump is intermittently tested.

2. Apparatus according to claim 1 wherein said control means comprises probe means located in said sump for providing a control signal when immersed in said liquid.

3. Apparatus according to claim 2 wherein said probe means comprises an insulating support, a plurality of electrically conductive probes depending from said support, and an imperforate, tubular shroud sealably closed at its upper end and surrounding at least the upper portions of said probes, the lower end of said shroud being open to permit said liquid to enter said shroud.

4. Apparatus according to claim 3 wherein the lower end of one of said conductive probes is located in proximity to the lower end of said shroud, and the lower end of another of said conductive probes is located a substantial distance above the lower end of said shroud.

5. Apparatus according to claim 4 wherein said another of said probes senses said second level when contacted by said liquid.

6. Apparatus according to claim 1 wherein said means responsive to said count prevents the energization of said AC operated pump at said next time said liquid surface is at said first level and said DC operated pump is energized.

* * * * *